US006422128B1

(12) United States Patent
Ahn

(10) Patent No.: US 6,422,128 B1
(45) Date of Patent: Jul. 23, 2002

(54) PISTON-ROTATION PREVENTING STRUCTURE FOR VARIABLE DISPLACEMENT SWASH PLATE TYPE COMPRESSOR

(75) Inventor: Hew Nam Ahn, Taejon-Si (KR)

(73) Assignee: Halla Climate Control Corp., Taejon-si (KR)

( * ) Notice: Subject to any disclaimer, the term of this patent is extended or adjusted under 35 U.S.C. 154(b) by 0 days.

(21) Appl. No.: 09/613,165

(22) Filed: Jul. 10, 2000

(51) Int. Cl.[7] ..... F01B 3/00
(52) U.S. Cl. ..... 92/71; 92/165 PR
(58) Field of Search ..... 92/165 PR, 165 R, 92/71; 417/222.1, 222.2

(56) References Cited

U.S. PATENT DOCUMENTS 5,490,767 A * 2/1996 Kanou et al. ..... 92/71
5,615,599 A * 4/1997 Terauchi ..... 92/71
5,706,716 A 1/1998 Umemura
5,720,215 A * 2/1998 Asplund et al. ..... 92/71
5,842,406 A 12/1998 Hiramatsu et al.
5,934,172 A * 8/1999 Terauchi ..... 92/71
6,010,313 A * 1/2000 Kimura et al. ..... 92/71
6,146,107 A * 11/2000 Kawaguchi et al. ..... 417/222.1

* cited by examiner

*Primary Examiner*—F. Daniel Lopez
*Assistant Examiner*—Igor Kershteyn

(57) ABSTRACT

A piston-rotation preventing structure for a variable displacement swash plate type compressor is disclosed. The piston-rotation preventing structure has a front housing and a cylinder block that constitute the housing of the compressor. The piston has a head portion and a jaw portion. The jaw portion is formed in the shape of an inverse U in such a way that a horizontal extension is horizontally extended from one side of the upper portion of the piston head portion and inside and outside jaws are respectively and vertically extended from both ends of the horizontal extension. The piston-rotation preventing structure comprises a pair of stopper grooves and a guide groove. The stopper grooves are extended along the upper surfaces of the horizontal extension and the piston head portion from the outer edge of the upper surface of the horizontal extension to a certain position on the upper surface of the piston head portion while being spaced apart from each other. The guide groove is longitudinally formed along the inner surface of the front housing over the stopper grooves to have the same width as the space between the stopper grooves.

18 Claims, 5 Drawing Sheets

Priot Art

PISTON-ROTATION PREVENTING STRUCTURE FOR VARIABLE DISPLACEMENT SWASH PLATE TYPE COMPRESSOR

BACKGROUND OF THE INVENTION

1. Field of the Invention

The present invention relates, in general, to variable displacement swash plate type compressors and, more particularly, to a piston-rotation preventing structure for a variable displacement swash plate type compressor that is capable of reducing the size and weight of its piston, thereby reducing the overall outside diameter of the compressor.

2. Description of the Prior Art

In a typical variable displacement swash plate type compressor, a drive shaft is rotatably mounted in the interior of a front housing, a plurality of cylinder bores are formed in a cylinder block that is fixed to the front housing to constitute an entire compressor housing, and the corresponding number of pistons are respectively and reciprocatably received in cylinder bores. Each of such pistons comprises a piston head portion and a jaw portion. The piston head portion sucks and compresses refrigerant gas by its reciprocating movement in a cylinder bore. The jaw portion is formed in the shape of an inverse U in such a way that a horizontal extension is horizontally extended from one side of the upper portion of the piston head portion, inside and outside jaws are respectively and vertically extended from both ends of the horizontal extension, and a recess is defined by the horizontal extension and the inside and outside jaws.

A swash plate is fitted around the drive shaft to be rotated together and the peripheral edge of the swash plate is inserted to the recess of the jaw portion, so that the piston constructed as described above is reciprocated forward and rearward by the rotation of a swash plate. For allowing the swash plate to be rotated without hindrance, two shoe pockets are respectively formed on the inner surfaces of the inside and outside jaws, and two semispherical shoes are respectively inserted into the shoe pockets to hold both surfaces of the peripheral edge of the swash plate. Additionally, a rotating prevention structure is formed on the piston so as to prevent the rotation of the piston due to the rotational resistance of the swash plate while the piston is reciprocated forward and reward.

One of conventional piston-rotation preventing structures for variable displacement swash plate type compressors is disclosed in U.S. Pat. No. 5,706,716. According to the patent, as is seen from FIG. 5, a piston 7 includes two projections 73 formed on both sides of the web 72 of the bridge portion 71 and is inserted into a cylinder bore 91 formed in a cylinder block 9. When the piston 7 receives rotational resistance due to the rotation of a swash plate (not shown) and is about to be rotated while the piston 7 is reciprocated by the rotation of the swash plate, the projections 73 that are projected considerably out of the range of the diameter of the cylinder bore 91 come into contact with the inner surface of the front portion of the housing 10. As a result, the piston is prevented from being rotated.

However, in the conventional piston-rotation preventing structure for a variable displacement swash plate type compressor, since the projections 73 are projected considerably out of the range of the diameter of the cylinder bore 91 or the outside diameter of the piston 7, not only the size and weight of the piston 7 but also the inside and outside diameters of the front portion of the housing 10 is increased.

SUMMARY OF THE INVENTION

Accordingly, the present invention has been made keeping in mind the above problems occurring in the prior art, and an object of the present invention is to provide a piston-rotation preventing structure for a variable displacement swash plate type compressor that is capable of reducing the size and weight of its piston and, consequently, reducing the overall outside diameter of the compressor.

In order to accomplish the above object, the present invention provides a piston-rotation preventing structure for a variable displacement swash plate type compressor, the compressor having a front housing and a cylinder block that constitute the housing of the compressor, the piston having a head portion and a jaw portion, the jaw portion being formed in the shape of an inverse U in such a way that a horizontal extension is horizontally extended from one side of the upper portion of the piston head portion and inside and outside jaws are respectively and vertically extended from both ends of the horizontal extension, comprising a pair of stopper grooves extended along the upper surfaces of the horizontal extension and the piston head portion from the outer edge of the upper surface of the horizontal extension to a certain position on the upper surface of the piston head portion while being spaced apart from each other; and a guide groove longitudinally formed along the inner surface of the front housing over the stopper grooves to have the same width as the space between the stopper grooves.

Preferably, the stopper groove may be situated within the range of the outside diameter of the piston or the inner diameter of the cylinder bore.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Figure 1A:
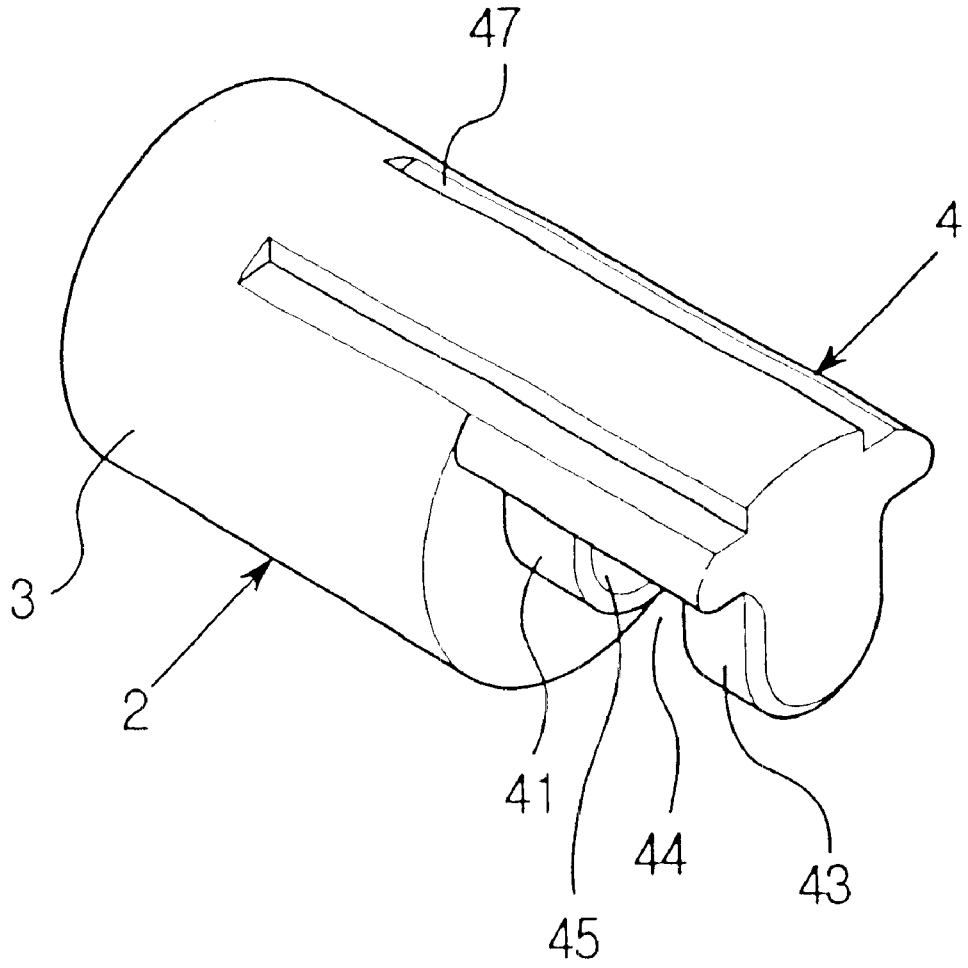
FIGS. 1A and 1B respectively show a perspective view and a side view of a piston with a piston-rotation preventing structure for a variable displacement swash plate type compressor in accordance with the present invention.

Reference now should be made to the drawings, in which the same reference numerals are used throughout the different drawings to designate the same or similar components.

Figure 4:
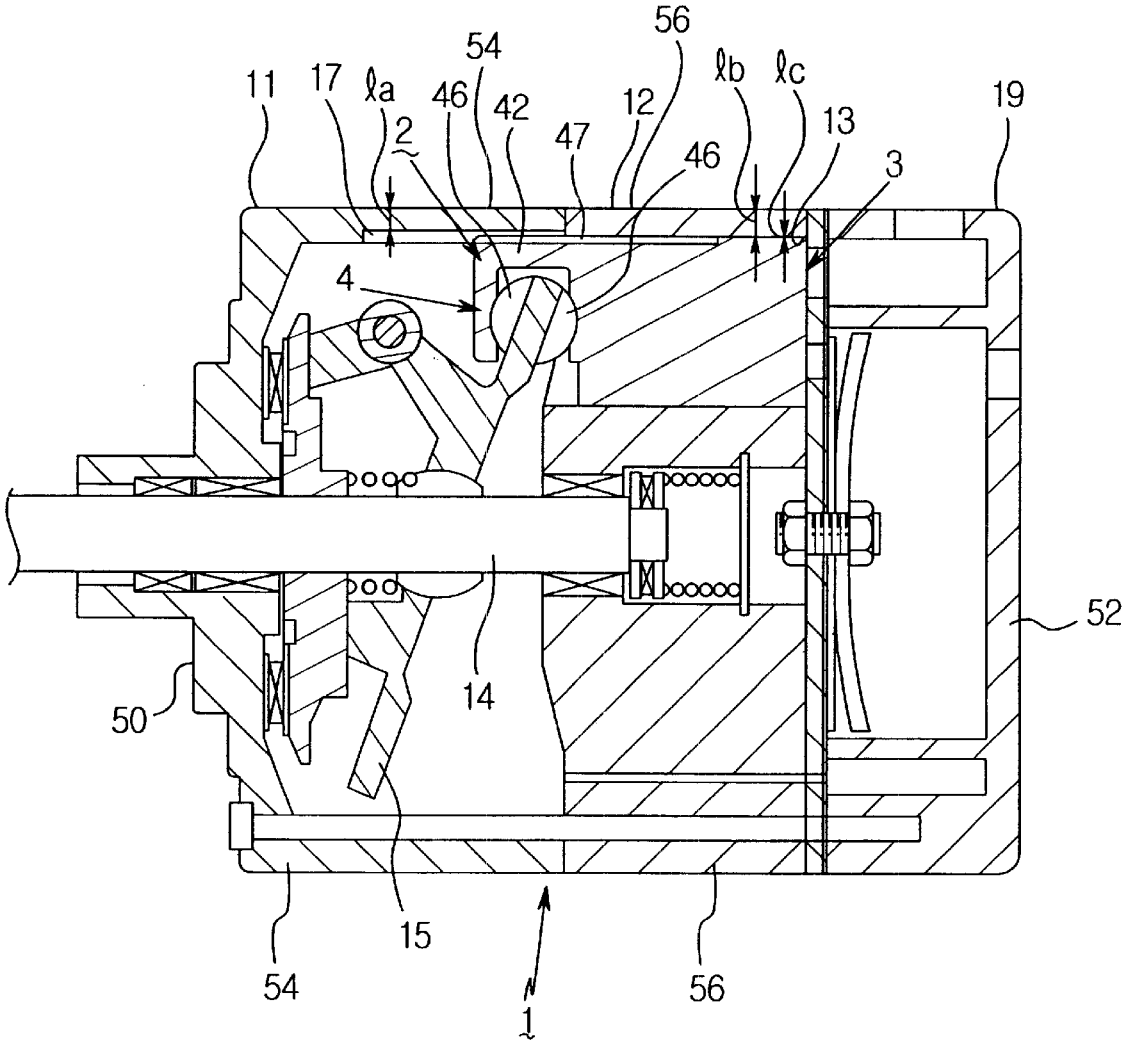
FIG. 4 is a sectional view of a compressor showing a variable displacement swash plate type compressor in which the piston-rotation prevention structure of the present invention is embodied.
Figure 5:
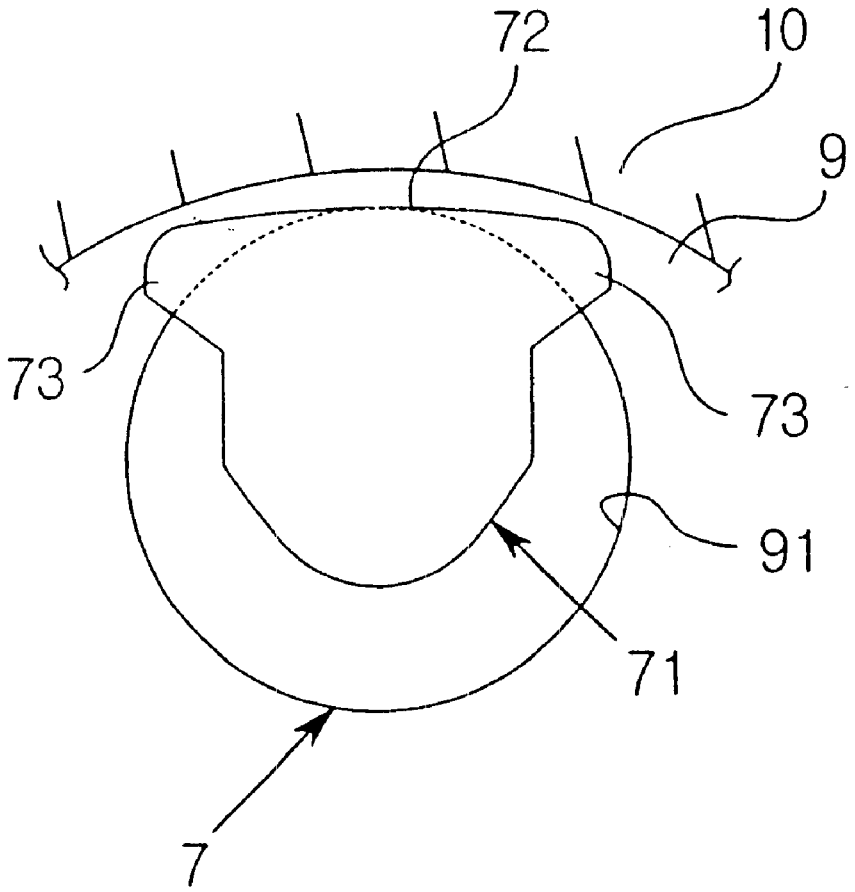
FIG. 5 is a sectional view showing a state where a piston having a piston-rotation prevention structure is inserted into a cylinder bore shown in U.S. Pat. No. 5,706,716.

As illustrated in FIG. 4, reference numeral 1 designates a variable displacement swash plate type compressor in accordance with the present invention. A drive shaft 14 is rotatably mounted in the exterior of a front housing 11 (a first housing member). Reference numeral 19 represents a rear housing (a second housing member). A drive shaft 14 is rotatably mounted in the interior of a front housing 11. A cylinder block 12 is fixed to the front housing 11 to form an entire compressor housing. A plurality of cylinder bores 13 are formed in the cylinder block 12, and the corresponding number of pistons 2 are respectively and reciprocatably received in the cylinder bores 13.

Figure 1B:
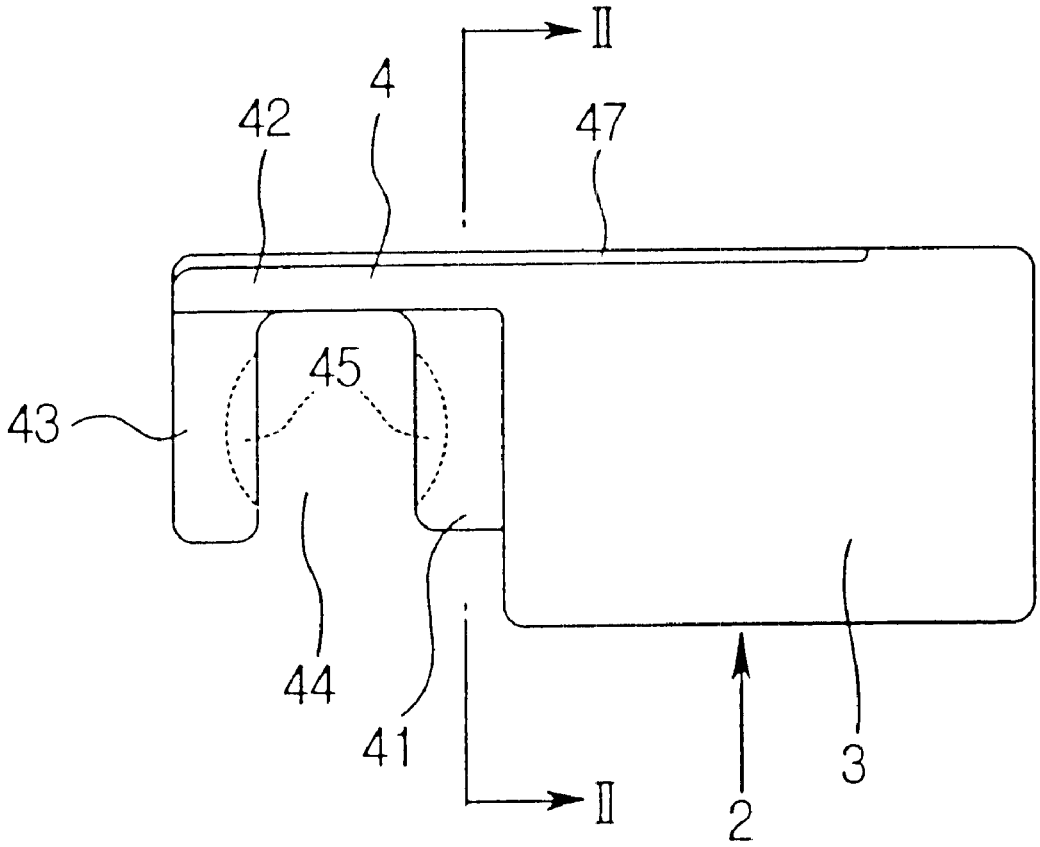
Figure 2:
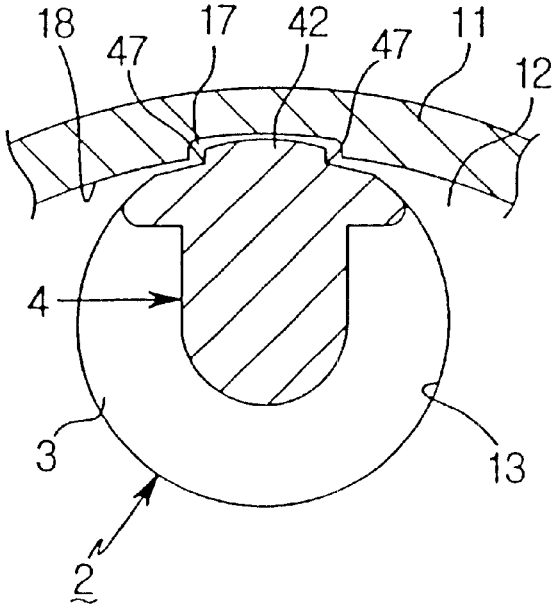
FIG. 2 is a sectional view of a piston showing a state where the piston having the piston-rotation prevention structure of the present invention is inserted into a cylinder bore.

As seen from FIGS. 1A and 1B, each of such pistons 2 comprises a piston head portion 3 and a jaw portion 4. The piston head portion 3 sucks and compresses refrigerant gas by its reciprocating movement in a cylinder bore 13. The jaw portion 4 is formed in the shape of an inverse U in such a way that a horizontal extension 42 is horizontally extended from one side of the upper portion of the piston head portion 3, inside and outside jaws 41 and 43 are respectively and vertically extended from both ends of the horizontal extension 42, and a recess 44 is defined by the horizontal extension 42 and the inside and outside jaws 41 and 43. As shown in FIGS. 1A and 1B (and 4,) a swash plate 15 is fitted around a drive shaft 14 in an inclined state to be rotated together with the drive shaft 14, and the swash plate 15 is inserted to the recess 44 of the jaw portion 4 at its peripheral edge. Accordingly, as the swash plate 15 is rotated together with the drive shaft 14, the phase of the swash plate 15 is continuously changed and, consequently, the piston 2 is reciprocated forward and rearward in a cylinder bore 13. For allowing the swash plate 15 to be rotated without hindrance, two shoe pockets 45 are respectively formed on the inner surfaces of the inside and outside jaws 41 and 43, and two semispherical shoes 46 are respectively inserted into the shoe pockets 45 to hold both surfaces of the peripheral edge of the swash plate 15.

Figure 3:
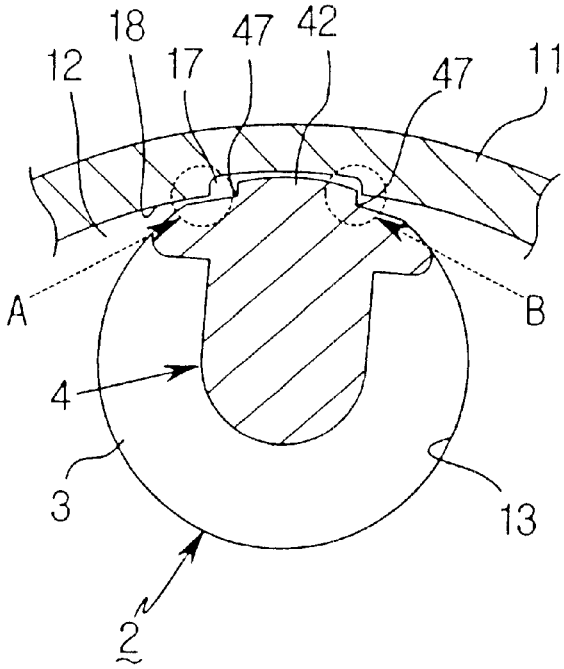
FIG. 3 is a sectional view of a piston showing the operation of the piston-rotation prevention structure of the present invention.

In accordance with the present invention, in order to prevent the piston 2 from being rotated by rotational resistance due to the rotation of the swash plate 15 during the reciprocation of the piston 2, two stopper grooves 47 (second grooves) are extended on the upper surfaces of the horizontal extension 42 and the piston head portion 3 from the outer edge of the upper surface of the horizontal extension 42 to a certain position on the upper surface of the piston head portion 3 while being spaced apart from each other, as shown in FIGS. 1 and 3. Therefore, the stopper grooves 47 are situated within the range of the outer diameter of the piston 2 or inside diameter of the cylinder bore 13. Additionally, in correspondence to the stopper grooves 47, a guide groove 17 (first groove) is longitudinally formed on the inner surface of the front housing 11 over said stopper grooves 47 to have the same width as the space between the stopper grooves 47.

The length of the stopper grooves 47 is preferably larger than that of the piston stroke. Meanwhile, the length of the guide groove 17 should be designed so that the front ends of the stopper grooves 47 do not deviate from the guide groove 17 during the reciprocation of the piston 2.

As a result, while the piston 2 starts from a normal state and is reciprocated forward and rearward in the cylinder bore 13 by the rotation of the swash plate 15, the piston 2 receives rotational resistance due to the rotation of the swash plate 15. However, since the stopper groove 47 that stands behind in a rotating direction comes into contact with the inside surface 18 of the front housing 11 adjacent to the guide groove 17 as shown in A of FIG. 3, the piston 2 is prevented from being rotated. At this time, as is seen from B of FIG. 3, the stopper groove 47 that is preceding in a rotating direction does not come into contact with the inside surface 18 of the front housing 11. In FIG. 4, reference numerals 50 and 52 represent a first end wall and a second end wall, respectively. Reference numerals 54 and 56 represent first and second substantially cylindrical side wall portions, respectively. A first thickness ($l_a$) is defined as a distance between an inner surface and an outer surface of the first cylindrical side wall portion 54 where the first groove 17 is formed in FIG. 4. A second thickness ($l_b$) is defined as a distance between an inner surface and an outer surface of the second cylindrical side wall portion 56 where the first groove 17 is not formed in FIG. 4. A shortest radial distance ($l_c$) is defined as a distance (gap) between an inner surface of the second substantially cylindrical wall portion 56 where the first groove 17 is not formed and a radially outmost surface of the cylinder bore (13). Though it appears that the inner surface of the cylindrical wall portion 56 contacts with the outmost surface of the cylinder bore 13 in FIG. 4, there exists a very narrow gap ($l_c$) between them since plural cylinder bores are generally inserted into the housing (56) as previously discussed. The gap represents the shortest radial distance ($l_c$). As shown in FIG. 4, it can be seen that the second thickness ($l_b$) is greater ($l_b > l_a + l_c$) than the sum of the first thickness ($l_a$) and the shortest radial distance ($l_c$).

As described above, the present invention provides a piston-rotation preventing structure for a variable displacement swash plate type compressor, in which there are provided a pair of stopper grooves that do not deviate from the range of the inside diameter of the cylinder bore and are extended axially, instead of conventional projections that are projected out of the range of the inside diameter of the cylinder bore. As a result, the piston is reduced in its size and weight in comparison with the conventional piston, thereby lowering the manufacturing cost of the piston.

The present invention provides a piston-rotation preventing structure for a variable displacement swash plate type compressor, in which a pair of stopper grooves do not deviate from the range of the inside diameter of the cylinder bore 13 and the inside and outside diameters of its front housing 11 can be reduced, thereby reducing the overall outside diameter of the compressor.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A piston, comprising:

a head having a front end, a circumference, and a rear end;

an inner jaw disposed on the rear end of the head;

a projection extending from the rear end of the head in a longitudinal direction, the projection having a free end and a surface substantially extending from the circumference of the head;

an outer jaw disposed on the free end of the projection and opposing the inner jaw, the inner and outer jaws together being configured to slidably engage with a swash plate; and a straight groove located on the surface of the projection and on the circumference of the head in the longitudinal direction.

2. The piston as defined in claim 1, wherein the straight groove is formed throughout the extension of the projection in the longitudinal direction.

3. The piston as defined in claim 2, wherein the straight groove extends from the projection up to a point on the piston between the front and rear ends of the head.

4. The piston as defined in claim 1, wherein the outer surface of the projection is curved.

5. The piston as defined in claim 4, wherein the circumference of the head continuously extends to the surface of the projection with the same curvature thereof.

6. The piston as defined in claim 4, wherein the straight groove is shaped like a step on the circumference of the head in a circumferential direction thereof.

7. The piston as defined in claim 6, wherein the circumference of the head is substantially cylindrical with the step-like groove in the circumferential direction.

8. The piston as defined in claim 1, further comprising another straight groove formed along the surface of the projection and the circumference of the head, the other straight groove being parallel to the straight groove.

9. The piston as defined in claim 1, further comprising a protrusion in a lateral direction from the outer jaw at the free end of the projection.

10. The piston as defined in claim 9, wherein a cross-section in the lateral direction of the protrusion is within a cross-sectional area of the circumference of the head.

11. A housing for a swash plate type compressor, comprising:

a hollow, substantially cylindrical side wall having first and second ends opposing in a longitudinal direction thereof;

a first end wall closing the first end of the substantially cylindrical wall, the first end wall having an opening adapted to pass a drive shaft therethrough;

a second end wall closing the second end of the substantially cylindrical wall, the second end wall having a plurality of openings for fluid communication with an outside; and the substantially cylindrical side wall comprising a first substantially cylindrical side wall portion and a second substantially cylindrical side wall portion, the first substantially cylindrical side wall portion having an inner surface comprising a first groove formed in a portion thereof along the longitudinal direction, the first groove configured to receive a piston having at least one second groove that is formed within an outer diameter of the piston such that the inner surface adjacent to the first groove comes into contact with the second groove while allowing the reciprocation of the piston by the rotation of the drive shaft.

12. The housing as defined in claim 11, wherein the first end wall and the first substantially cylindrical side wall portion constitute a first housing member, and the second end wall and the second substantially cylindrical side wall portion constitute a second housing member.

13. The housing as defined in claim 12, wherein the first housing member defines a chamber adapted to receive a swash plate connected to the drive shaft and adapted to allow a piston to reciprocate therein, and wherein the second housing member defines a space adapted to receive a cylinder block having at least one cylinder bore.

14. The housing as defined in claim 11, wherein the first substantially cylindrical side wall portion has a first thickness that is defined as a distance between an inner surface and an outer surface of the first cylindrical side wall portion where the groove is formed, wherein the second substantially cylindrical side wall portion has a second thickness that is defined as a distance between an inner surface and an outer surface of the second cylindrical side wall portion where the groove is not formed, and wherein the first thickness is less than the second thickness.

15. The housing as defined in claim 14, wherein a shortest radial distance is defined between an inner surface of the second substantially cylindrical side wall portion and a radially outmost surface of the cylinder bore, and wherein the second thickness is greater than the sum of the first thickness and the shortest radial distance.

16. A swash plate type compressor, comprising:

a drive shaft;

a swash plate having a center and a circumference, the center of the swash plate being connected to the drive shaft;

at least one piston having a head portion and a jaw portion, the jaw portion being slidably engaged with the circumference of the swash plate with a pair of shoes;

a cylinder block having at least one cylinder bore slidably receiving the piston head;

a housing having an inner surface comprising a first groove formed in a portion thereof along a longitudinal direction, the first groove configured to receive the piston having at least one second groove that is formed within an outer diameter of the piston such that the inner surface adjacent to the first groove comes into contact with the second groove while allowing the reciprocation of the piston by the rotation of the drive shaft.

17. The compressor as defined in claim 16, wherein the piston has two grooves, and wherein the housing has an inner surface, and wherein the inner surface of the housing has a mating portion corresponding to the grooves of the piston.

18. The compressor as defined in claim 16, wherein the groove extends from the jaw portion up to a position of the head of the piston.

* * * * *